US006100634A

United States Patent [19]

Scholz

[11] Patent Number: 6,100,634

[45] Date of Patent: Aug. 8, 2000

[54] METHOD FOR AMALGAM RELOCATION IN AN ARC DISCHARGE TUBE

[75] Inventor: John A. Scholz, Danvers, Mass.

[73] Assignee: GTE Products Corporation, Danvers, Mass.

[21] Appl. No.: 07/805,703

[22] Filed: Dec. 11, 1991

[51] Int. Cl.[7] ..... H01J 1/62

[52] U.S. Cl. ..... 313/490; 313/623; 313/624; 313/625

[58] Field of Search ..... 313/490, 623, 313/624, 625

[56] References Cited

U.S. PATENT DOCUMENTS

| | | | |
|---|---|---|---|
| 3,716,744 | 2/1973 | Delembre et al. | 313/625 |
| 3,851,207 | 11/1974 | McVey | 313/550 |
| 4,157,485 | 6/1979 | Wesselink et al. | 313/490 |
| 4,539,508 | 9/1985 | Mulder et al. | 313/490 |
| 4,910,430 | 3/1990 | Ito et al. | 313/623 |
| 4,975,620 | 12/1990 | Masui et al. | 313/624 |

*Primary Examiner*—Vip Patel

*Attorney, Agent, or Firm*—Joseph S. Romanow; William H. McNeill

[57] ABSTRACT

An arc discharge tube has electrodes supported by hollow electrode support tubes at each end. A slot is formed in the electrode support tube. One edge of the slot is depressed inwardly to form a concave surface. The slot is located adjacent to the end cap of the arc tube and provides access to the interior of the electrode support tube. After the electrode assembly is sealed into one end of the arc tube, amalgam particles are dispensed into the arc tube. The arc tube is agitated rapidly, causing the amalgam particles to pass through the slot and drop into the interior of the electrode support tube. The amalgam particles are isolated from heat during sealing of the other end of the arc tube.

4 Claims, 2 Drawing Sheets

METHOD FOR AMALGAM RELOCATION IN AN ARC DISCHARGE TUBE

FIELD OF THE INVENTION

This invention relates to high pressure arc discharge lamps and, more particularly, to methods for transferring an amalgam into an electrode support tube at the end of an arc tube.

BACKGROUND OF THE INVENTION

High pressure sodium arc discharge lamps have been in commercial production for many years and have been subject to many improvements in design, materials and processing. Such lamps include a translucent ceramic arc tube, a light-transmissive lamp envelope, a base connector and a frame for supporting the arc tube within the lamp envelope. The frame is electrically conductive and carries power to the arc tube. The arc tube is typically fabricated of polycrystalline alumina or yttria and contains an amalgam of mercury and sodium for producing light having a desired output spectrum. Tungsten or molybdenum electrodes are mounted within the arc tube at opposite ends and are attached to feedthroughs selected to have thermal expansion characteristics closely matched to those of the ceramic arc tube. The feedthroughs are hermetically sealed in openings at opposite ends of the arc tube. Niobium, usually containing about 1% zirconium by weight, is the preferred feedthrough material for alumina arc tubes.

In one commonly used electrode feedthrough structure, the feedthrough is a niobium tube. A tungsten coil electrode is attached to the niobium tube by a tungsten support rod. The opening in each end of the arc tube is sufficiently large for insertion of the electrode and the niobium tube. An insert button is sintered directly into the end of the arc tube, and a ceramic sealing button or ring is sealed with a low melting point ceramic frit to the end of the arc tube and the feedthrough to extend the length of the seal and to improve its reliability.

In one prior art method for manufacturing arc tubes, an electrode assembly is sealed in one end of the arc tube, and the required chemical fill is introduced into the arc tube through the open end. Then, the end cap containing an electrode assembly is bonded to the other end of the arc tube. The niobium tube of the second electrode assembly is used as an exhaust tube. The exhaust tube is connected to a system used to purge the arc tube of undesirable gaseous components and to permit the addition of the required gas fill. After the gas filling operation, the exhaust tube is sealed, typically by crimping and welding.

Another prior art technique for manufacturing arc tubes involves sealing an electrode assembly and end cap into one end of the arc tube. The chemical fill for the arc tube is introduced through the open end of the arc tube. The second end cap and the electrode assembly are then loosely positioned on the open end of the arc tube, and the arc tube is placed in a chamber that can be purged of undesired gases and then refilled with the desired gas. Then the region of the second end cap is heated, causing the cap to be hermetically sealed to the arc tube body. An advantage of this process is that it permits batch processing of many units at one time.

Smaller and lower wattage high pressure sodium arc tubes have recently been developed for various applications. The above-described arc tube manufacturing processes have been found unsuitable for manufacturing such smaller and lower wattage arc tubes. One problem is that an excessive amount of heat is transferred during sealing of the second end cap and electrode assembly to the volatile chemical fill material. This results in vaporization of the chemical fill and migration of the chemical fill out of the arc tube before it is sealed. It has been found that the smaller the length of the arc tube, the greater the tendency to lose its chemical fill during processing. Proposed methods to shorten the thermal cycle or to reduce heat transfer to the chemical fill have been only partially successful.

It is known in the prior art to construct high pressure sodium arc tubes so that the interior of the electrode feedthrough tube is connected to the discharge region in the ceramic arc tube by a passage of sufficient cross section to permit flow of the vaporized fill material. The interior of the feedthrough tube is usually lower in temperature than the discharge region of the arc tube. Therefore, the fill material tends to condense in the feedthrough tube. This construction is commonly referred to as an external reservoir arc tube, since the fill material condenses in a region external to the discharge region.

External reservoir construction is disclosed in U.S. Pat. No. 4,342,938 issued Aug. 3, 1982 to Strok, European Patent application No. 0,225,944 published Jun. 24, 1987, U.S. Pat. No. 4,827,910 issued May 2, 1989 to Masui et al, European Patent application No. 0,265,266 published Apr. 27, 1988, U.S. Pat. No. 4,035,682 issued Jul. 12, 1977 to Bubar and U.S. Pat. No. 4,065,691 issued Dec. 27, 1977 to McVey. The external reservoir arc lamp construction is believed to provide lower sodium loss than conventional arc lamps and to provide a more constant level of light output over the life of the arc lamp.

It is a general object of the present invention to provide improved high pressure arc discharge lamps.

It is another object of the present invention to provide improved methods for manufacturing high pressure arc discharge lamps.

It is a further object of the present invention to provide methods for transferring a chemical fill into an electrode feedthrough tube of an arc discharge lamp.

It is a further object of the present invention to provide methods for manufacturing arc discharge lamps wherein loss of chemical fill during processing is substantially reduced.

SUMMARY OF THE INVENTION

According to the present invention, these and other objects and advantages are achieved in a method for charging an arc tube assembly with a chemical fill. The method comprises the steps of providing an electrode assembly including an electrode attached to an electrode support tube having a generally cylindrical wall, forming an opening in the wall of the electrode support tube, mounting the electrode assembly in one end of an arc tube with the opening located inside the arc tube, dispensing a chemical fill into the arc tube, and moving the arc tube so as to cause the chemical fill to pass through the opening and drop into an interior region of the electrode support tube. The step of moving the arc tube typically includes repetitively moving the arc tube.

The step of forming an opening in the wall of the electrode support tube preferably includes forming a slot in the electrode support tube and depressing one edge of the slot inwardly relative to the other edge of the slot to form a concave surface adjacent to the slot. In a first embodiment, the slot is generally perpendicular to the longitudinal axis of the electrode support tube, and the arc tube is repetitively moved from side to side so as to agitate the particles of chemical fill and cause them to pass through the slot into the interior of the electrode support tube. In a second embodiment, the slot is generally parallel to the longitudinal axis of the electrode support tube, and the arc tube is rotated about an axis that is parallel to or coincident with its longitudinal axis so as to cause particles of the chemical fill to be agitated and pass through the slot.

According to another aspect of the invention, there is provided an arc tube assembly comprising a light-transmissive arc tube having an end cap sealed to each end thereof, an electrode assembly sealed in each of the end caps, each electrode assembly comprising an electrode attached to an electrode support tube, and a chemical fill in an interior region of at least one of the electrode support tubes. At least one of the electrode support tubes has an opening adjacent to the respective end cap. The opening comprises a slot in a cylindrical wall of the electrical support tube. The slot has one edge depressed relative to the other edge to form a concave surface that facilitates passage of the chemical fill through the slot into the interior of the electrode support tube.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
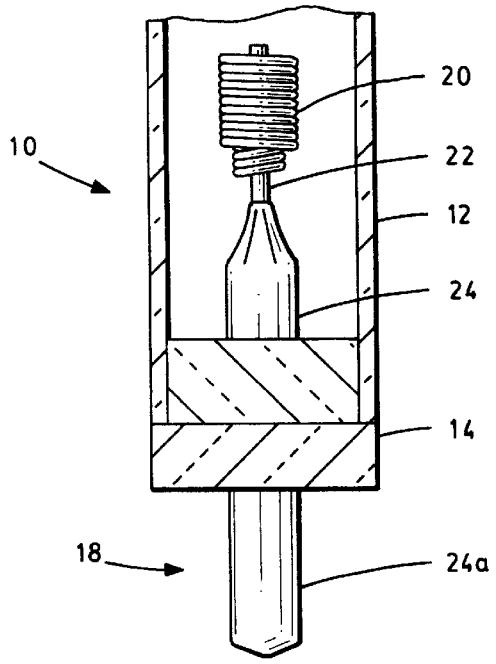
FIG. 1 is an elevation view of one end of an arc tube assembly showing mounting of an electrode assembly.

One end of an arc tube assembly 10 is shown generally in FIG. 1. A cylindrical arc tube 12, typically fabricated of alumina, has an end cap 14 sealed to one end. An electrode assembly 18 is mounted in end cap 14. The electrode assembly 18 includes a coil-on-coil electrode 20, typically tungsten, affixed to a support rod 22, typically tungsten. The support rod 22 is crimped and welded into a feedthrough tube, or electrode support tube, 24. The electrode support tube 24 is preferably fabricated of niobium to closely match the thermal characteristics of the alumina arc tube 12. The electrode support tube 24 is sealed to end cap 14 with a frit, as known in the art. A portion 24a of electrode support tube 24 is located outside the arc tube 12 and is hermetically sealed. The portion 24a is used for mounting of the arc tube assembly 10 and for electrical connection to electrode 20. The opposite end of the arc tube assembly 10 typically has the same construction as shown in FIG. 1. The arc tube assembly 10 is mounted in a light-transmissive envelope (not shown) to provide an arc discharge lamp, as known in the art.

Figure 2A:
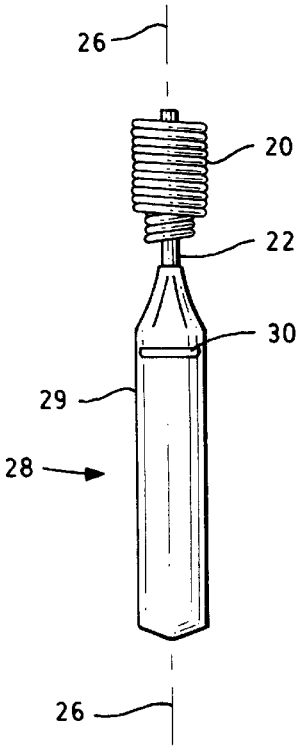
FIGS. 2A and 2B illustrate formation of a slot in the electrode support tube in accordance with the present invention.

An electrode assembly 28 including electrode support tube 29, support rod 22 and electrode 20 is shown in FIG. 2A. In accordance with the present invention, a slot 30 is cut in the electrode support tube 29. The slot 30 extends through the cylindrical wall of support tube 29 to its interior region. The slot 30 is located near the end of support tube 29 adjacent to electrode 20 but is spaced at least slightly from the crimped portion. The slot 30 can be formed, for example, by cutting with a carbide blade. In the embodiment of FIG. 2A, the slot 30 is perpendicular to a longitudinal axis 26 of electrode support tube 24 and extends almost the full width of support tube 29. In a preferred embodiment, the slot 30 had dimensions of 0.020 inch by 0.150 inch for an electrode support tube 29 having a diameter of 0.156 inch and a wall thickness of 0.010 inch.

Figure 2B:
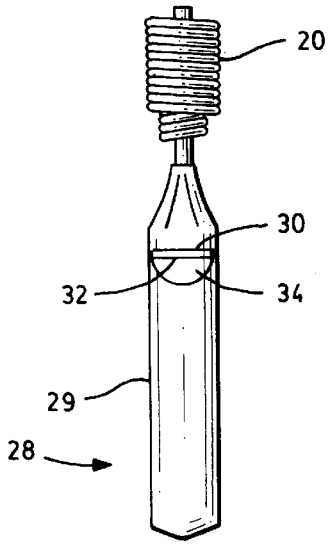

Next, one edge of slot 30 is depressed inwardly relative to the other edge as shown in FIG. 2B. Preferably, an edge 32 located farthest from electrode 20 is depressed inwardly to form a concave surface 34 adjacent to slot 30.

Figures 3A, 3B, 3C:
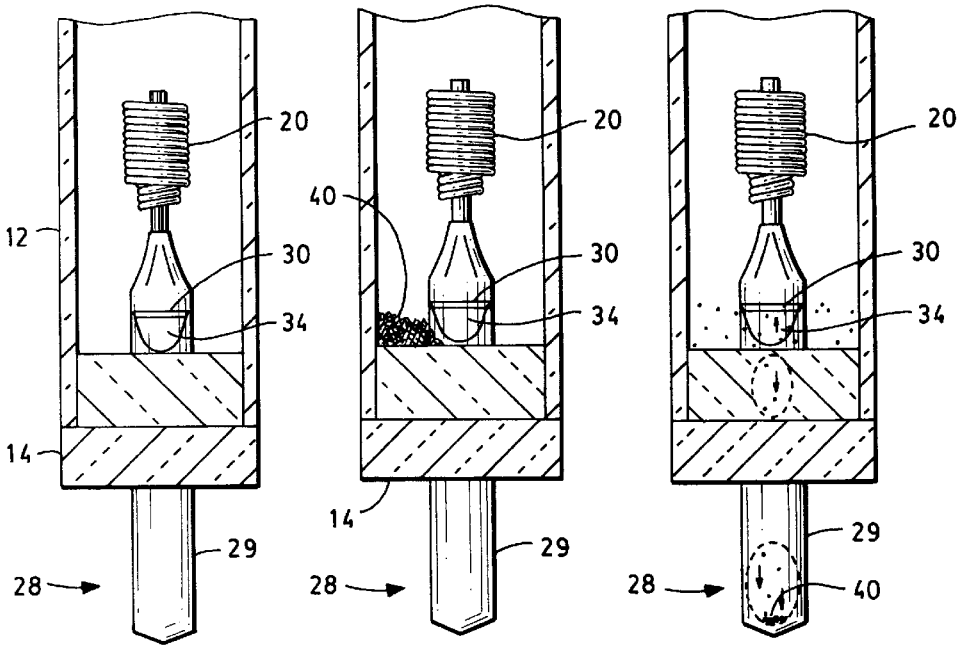
FIGS. 3A–3C illustrate the steps in location of an amalgam in accordance with the present invention, for a slot that is perpendicular to the axis of the arc tube.

Referring now to FIG. 3A, the electrode assembly 28 is hermetically sealed into end cap 14 with slot 30 and concave surface 34 spaced slightly from end cap 14. Preferably, a spacing between slot 30 and end cap 14 of about 0.080 inch is used to prevent the sealing frit from clogging slot 30 during the sealing process. Then, the end cap 14 containing electrode assembly 28 is sealed into arc tube 12.

After sealing end cap 14 and electrode assembly 28 into arc tube 12, a chemical fill comprising amalgam particles 40 is dispensed into the arc tube as shown in FIG. 3B. This step is preferably performed in an anaerobic chamber designed for handling of the anhydrous chemicals that are used in lamp manufacture. The chemical fill for a high pressure sodium lamp typically comprises a high purity sodium-mercury amalgam. It has been found convenient to utilize an amalgam in the form of spherical particles of a size range varying between 240 micrometers and 480 micrometers in diameter.

Next, the arc tube 12 with end cap 14 and electrode assembly 28 sealed in one end is held in a vertical or near vertical orientation with amalgam particles 40 resting on end cap 14. The arc tube assembly is then rapidly moved back and forth, causing turbulence and agitation of the amalgam particles 40 within the arc tube 12. As the amalgam particles 40 move within the arc tube, some contact the concave surface 34 adjacent to slot 30. The particles 40 are directed by their momentum and the concave shape of surface 34 into slot 30. The particles 40 then drop into the closed end of electrode support tube 29 as shown in FIG. 3C. The agitation of the arc tube to provide relocation of the amalgam particles inside support tube 29 can be assisted by use of a mechanical vibratory instrument, such as the type used to mix dental filling mixtures. The arc tube can be agitated over a wide range of frequencies, but is preferably agitated at a frequency in the range of about 100 to 1000 cycles per second. When such an instrument is used, it has been found that all the amalgam particles are relocated into the electrode support tube 29 in a very short time, typically as little as one second.

When the amalgam particles 40 have been transferred to the interior of electrode support tube 29, as described above, the arc tube assembly is ready for the final process steps. The arc tube is purged of undesirable gaseous constituents and is backfilled with a desired gas such as xenon. Then, the second electrode assembly and end cap are hermetically sealed to the other end of the arc tube 12.

By locating the amalgams particles 40 in the interior of electrode support tube 29 as described above, the amalgam is located away from the source of heat required for sealing the second electrode assembly into the other end of the lamp. The amalgam is shielded from the heat source by end cap 14 located immediately above the amalgam particles 40.

Furthermore, the amalgam particles 40 can easily be heat sinked or actively cooled during processing. The electrode support tube 29 is metallic and is an efficient thermal conductor. The electrode support tube 29 can be inserted into a suitably sized opening in a metal fixture for cooling during the second seal process.

Figures 4A, 4B, 4C:
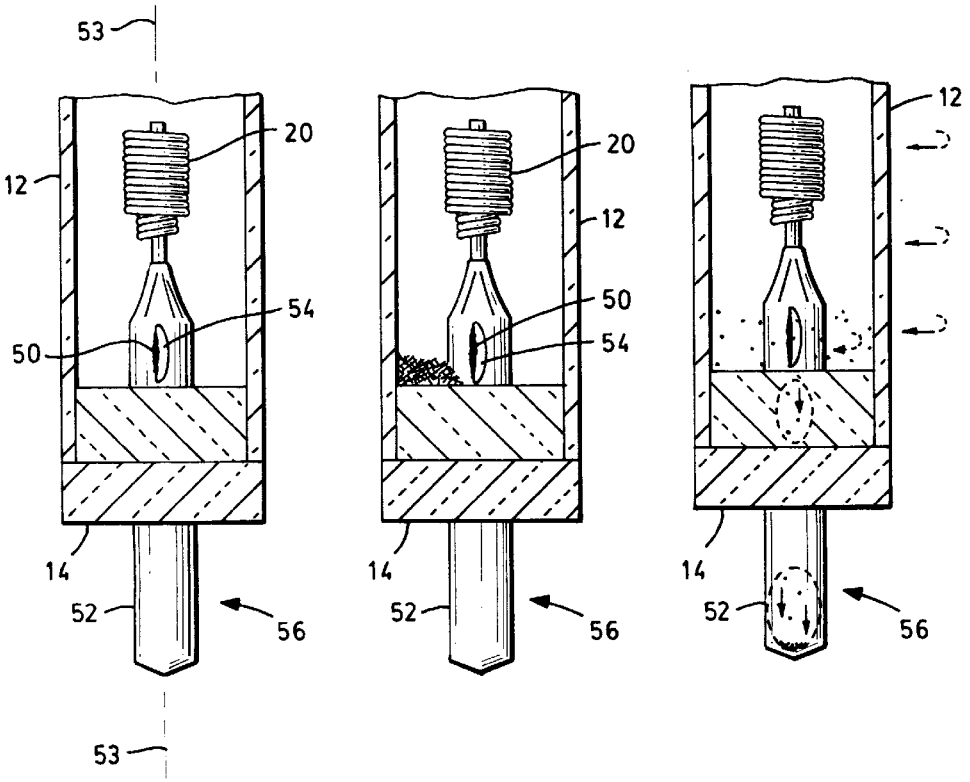
FIGS. 4A–4C illustrate the steps in location of an amalgam in accordance with the present invention, for a slot that is parallel to the arc tube axis.

An alternate embodiment of the invention is illustrated in FIGS. 4A to 4C. A slot 50 is formed in an electrode support tube 52. In this case, the slot 50 is oriented parallel to a longitudinal axis 53 of electrode support tube 52. One edge of slot 50 is depressed inwardly to form a concave surface 54 adjacent to slot 50. Electrode assembly 56 is sealed into end cap 14 with slot 50 spaced at least slightly from end cap 14. Then, the end cap 14 containing electrode assembly 56 is sealed into arc tube 12. The slot 50 can have the same dimensions as slot 30 shown in FIGS. 3A–3C and described above. Next, amalgam particles 40 are dispensed into the arc tube as shown in FIG. 4B. The arc tube assembly is oriented at an angle of about 45° to 60° with respect to vertical and is rotated so as to agitate amalgam particles 40 and cause them to pass through slot 50 and drop into the interior of electrode support tube 52. The arc tube 12 is rotated about an axis that is parallel to or coincident with the central axis of arc tube 12. With an angled orientation of the arc tube assembly during rotation, amalgam particles 40 effectively fall through slot 50. In the case of an axial slot 50, rotation has been found preferable to side-to-side agitation. However, either method can be used. After location of amalgam particles 40 in the interior of electrode support tube 52, the arc tube 12 is purged of undesired gas components and is backfilled with a desired gas. Then, the second electrode assembly and end cap are sealed to the opposite end of the arc tube.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An are tube assembly comprising:

a light-transmissive arc tube having an end cap sealed to each end thereof;

an electrode assembly sealed in each of said end caps, each electrode assembly comprising an electrode attached to an electrode support tube, each electrode support tube having a generally cylindrical wall, at least one of said electrode support tubes having an opening adjacent to the respective end cap, said opening comprising a slot in the wall of said electrode support tube, said slot having one edge depressed relative to the other edge so as to define a concave surface adjacent to said slot; and a chemical fill in an interior region of the electrode support tube having said opening.

2. An arc tube assembly as defined in claim 1 wherein said chemical fill comprises amalgam particles.

3. An arc tube assembly as defined in claim 2 wherein said slot is generally perpendicular to a longitudinal axis of said electrode support tube.

4. An arc tube assembly as defined in claim 2 wherein said slot is generally parallel to a longitudinal axis of said electrode support tube.

* * * * *